United States Patent [19]

Göhringer et al.

[11] 4,288,004

[45] Sep. 8, 1981

[54] CIGARETTE DISPENSER WITH A LIGHTING ARRANGEMENT

[76] Inventors: Willi Göhringer, Glagenbergstr. 56; Friedrich Hachtel, Ziegelstr. 132, both of 7080 Aalen; Wolf E. Müller, Balsewitzer Ring 4, 1 Berlin 20, all of Fed. Rep. of Germany

[21] Appl. No.: 69,994

[22] Filed: Aug. 27, 1979

[51] Int. Cl.[3] ..... A24F 15/10

[52] U.S. Cl. ..... 221/147; 221/266

[58] Field of Search ..... 221/143, 144, 145, 146, 221/147, 266, 236; 312/86

[56] References Cited

U.S. PATENT DOCUMENTS

| | | | |
|---|---|---|---|
| 2,370,230 | 2/1945 | Cheechoo | 221/147 X |
| 2,552,481 | 5/1951 | Eberhardt et al. | 221/147 |
| 3,186,590 | 6/1965 | Beha et al. | 221/147 |
| 3,294,285 | 12/1966 | Kovacevic | 221/147 |
| 3,366,275 | 1/1968 | Beha et al. | 221/147 |

*Primary Examiner*—Allen N. Knowles

[57] ABSTRACT

A cigarette dispenser having a housing with a cigarette lighting arrangement therein, the housing having a storage chamber for the cigarettes, an incandescent wire cigarette lighting head disposed in the interior of the housing, and an arrangement for sliding out lighted cigarettes from an opening in the housing.

10 Claims, 3 Drawing Figures

FIG. 2
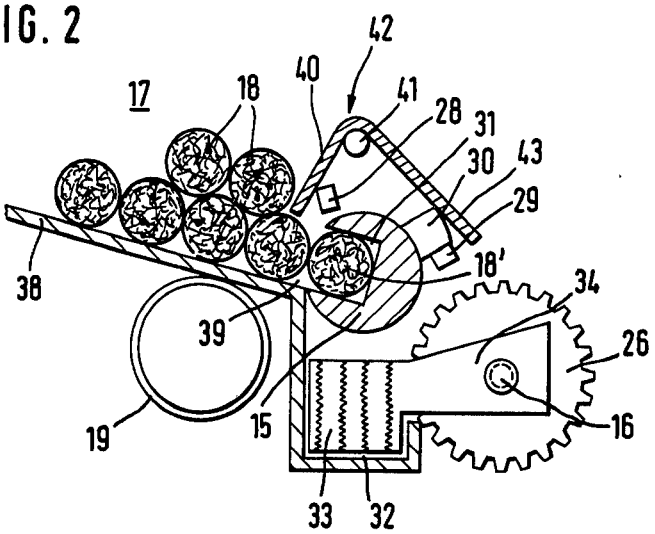
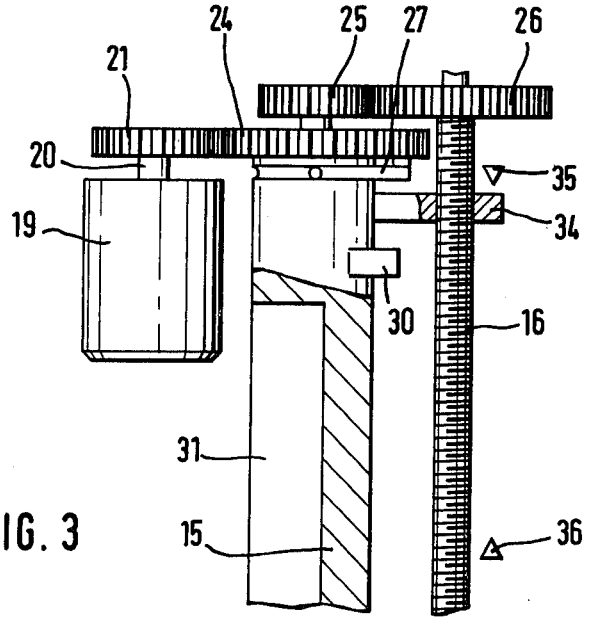
FIG. 3

CIGARETTE DISPENSER WITH A LIGHTING ARRANGEMENT

The invention relates to a cigarette dispenser having a housing with a cigarette lighting arrangement therein, the housing having a storage chamber for the cigarettes, an incandescent wire cigarette lighting head disposed in the interior of the housing, and an arrangement for sliding out lighted cigarettes from an opening in the housing.

Cigarette dispensers of the aforedescribed type are already known (see for example German utility models Nos. 7228465 and 7232632). These known cigarette dispensers with lighting means have the drawback that the cigarettes must be inserted separately and individually into a drum magazine, an operation which is quite time consuming. Moreover, these known conventional cigarette dispensers have a complex lever mechanism for lighting and pushing out the lighted cigarettes.

It is among the objects of this invention to provide a cigarette dispenser having a lighting means, which is inexpensive to manufacture, which operates without malfunctioning, and into which the cigarettes can be loosely fed and do not require to be individually placed in a predetermined position within the housing of the cigarette dispenser.

This object is attained by means of a cigarette dispenser of the aforedescribed type, wherein the bottom of the storage chamber is formed in the shape of a funnel and terminates in a dispensing slot. Behind this dispensing slot is arranged a rotatable drum or shaft which has a single slot for receiving a single cigarette and which is rotatable in opposite direction by gears, a disconnectable coupling, and a reversible electric motor. There is provided underneath the rotatable drum a cigarette expelling channel, parallel to which there is mounted a traversing screw driven by the electric motor. The cigarette lighting means or glow head also serves as a cigarette expelling member and is adapted to project into the expelling channel, the glow head being drivingly connected to the electric motor and to be reciprocated between two terminal positions by the traversing screw.

The cigarette dispenser constructed in accordance with the invention has the advantage that cigarettes can be fed in a loosely and non-sorted condition into the storage chamber from which the stacked superposed cigarettes are individually fed to the outlet slot and thence to the rotatable drum that is mounted beyond the outlet slot. The clogging of the cigarettes in the outlet slot is avoided by means of a swingable mounted flap in the storage chamber which is positioned near the inlet of the outlet slot. Such swingable flap also forms a partial separating wall in the storage chamber and moves in dependancy with the movement of the rotatable drum. Due to such movement of the swingable flap, the cigarette which lies above the cigarette disposed in the outlet slot and which would be the next cigarette to be expelled causes no pressure on the cigarette in the outlet slot thereby preventing a jamming of cigarettes in the outlet slot.

The electric motor drive for the dispensing arrangement of the cigarette dispenser provides for the uniform operation of the expelling of the cigarettes and protects the entire mechanism against overloading which is always a problem with cigarette dispensers which are manually operated.

A further advantage of the cigarette dispenser in accordance with the invention is that the incandescent cigarette lighter or glow head serves to expel a cigarette that has been lighted. The lighting or igniting of the cigarette occurs during the time that it is being slid out on the dispenser by the glow head, the glow head which bears against an end of cigarette and lights it being simultaneously driven in a direction parallel to the drum by the traversing screw. The distance through which the lighted cigarette is slid outwardly of the housing of the dispenser is such that it is assured that the cigarette is lighted by the glow or incadescent head before the unlighted end thereof projects outwardly of the housing of the dispenser so that is can be grasped by the smoker.

The adjustment of direction of the rotation of the electric motor and the current supply of the glow head are under the control of limit switches which are actuated by the glow head at the ends of its path of reciprocation. The glow head is reciprocated between two stop surfaces by means of the traverse screw which is driven by the electric motor.

The construction of the dispensing arrangement for the cigarette dispenser is simple and is inexpensive to manufacture. The drive motor can be any conventional reversible electric motor that is manufactured in small sizes, and which can be positively drivingly connected to the traversing screw. The coupling between the driving motor and the shaft of the drum, in the disclosed embodiment, is effected by means of a simple leaf spring arrangement. The range of oscillation of the rotatable drum is limited by fixed limit surfaces, which, when the drum has reached either of its end terminal positions, cause the leaf spring to deflect and thereby to couple the drum to the electric motor.

BRIEF DESCRIPTION OF THE DRAWINGS

There follows now a description and illustration of a preferred embodiment of a cigarette dispenser in accordance with the invention which is explained in detail in the accompanying drawings.

In the drawings:

FIG. 2 is a fragmentary view, partially in vertical section and partially in side elevation, through the dispensing unit of the cigarette dispenser, the section being taken along the line II—II in FIG. 1;

FIG. 3 is a fragmentary view in plan of those parts of dispensing unit which are shown in FIG. 2.

DETAILED DESCRIPTION

Figure 1:
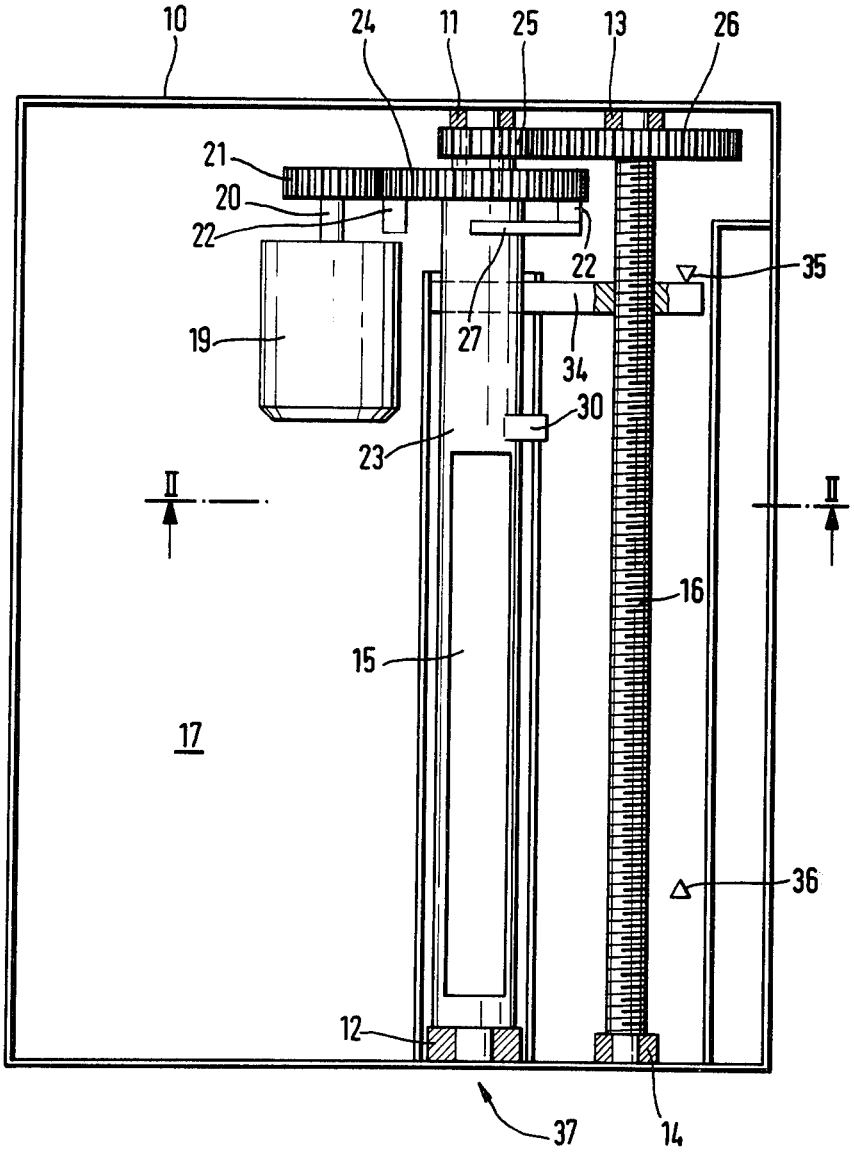
FIG. 1 is a plan view of the cigarette dispenser from which the top of the housing has been removed for the sake of clarity of illustration.

The cigarette dispenser illustrated in FIG. 1 has a housing 10 of parallelepiped-shape, such housing being conveniently made of plastic material. Housing 10, which may be provided with a pivotally mounted cover (not shown) has a first set of bearings of 11, 12, mounted upon opposite walls thereof, such bearings rotatably mounting a shaft or drum 15. Also mounted upon the same opposite walls of the housing are further bearings 13, 14, which journal a traverse screw 16 therebetween. The housing 10 has a storage chamber 17, schematically illustrated, in the interior thereof, in its upper portion, the storage chamber being adapted to accomodate loosely a number of cigarettes 18 disposed in a mutually parallel relationship as shown in FIG. 2. The chamber 17 has a bottom wall 38 upon which the cigarettes rest, wall 38 slanting downwardly toward the drum 15.

A miniature electric motor 19 is mounted beneath the lower wall 38 of the storage chamber 17. Motor 19 may be either of the A.C. or D.C. type; when it is of the A.C. type, it may be supplied with electric current from a transformer (not shown) inside the housing 10. When motor 19 is of the D.C. type, there may be employed a battery inside the housing 10 to supply the current for the motor. Motor 19 has a drive shaft 20 to which there is affixed a pinion 20 which is constantly in mesh with a larger gear 24 mounted on the shaft at the end of drum 15 to rotate freely with respect thereto. A pinion 25 affixed to gear 24, constantly meshes with a larger gear 26 affixed to an end of the traverse screw 16.

Projecting axially inwardly from the gear 24 are two diametrically spaced peg-like projections which extend axially into the path of the radially outer end of a leaf spring 27 affixed to the drum 15 and extending tangentially thereof.

It will be seen from the above that there is a continuously driving connection between the motor 19 and the traversing screw 16 by way of the gears 21, 24, 25, and 26. The projections 22 and the leaf spring 27 attached to portion 23 of the drum 25 form a disconnectable coupling between the motor and the drum. The drum 15 is restricted in its rotation from the position thereof shown in FIG. 2, in which a radial projection 30 on portion 23 of the drum 15 engages a first lower stop 29, and a position in which the member 30 engages a second, upper fixed stop 28. The motor 19 continues to run to drive the traverse screw 16 as required, the projections 22 on gear 24 bending the leaf spring 27 each time they encounted it so as to permit the projections to pass the spring and the gear 24 to continue to rotate.

As shown on FIGS. 2 and 3 the drum 15 has an axially extending recess 31 therein of such length and width as to receive a cigarette therein. The recess 31 is disposed in the drum 15 so that its open end faces the row of cigarettes lying upon the wall 38 when the projection 30 on the drum engages the lower stop 29. The cigarette which is shown disposed in recess 31 and 32 is designated 18'.

When the motor 19 is energized to rotate the drum 15 counterclockwise (FIG. 2) the drum 15 is rotated counterclockwise until member 30 engages stop 28. At that time the open side of the recess 31 is directed downwardly and to the left so that the cigarette 18' is able to drop out of the recess into a cigarette channel 32 disposed in the housing beneath the drum 15. It will be seen that when the drum 15 is turned into its counterclockwise terminal position the par cylindrical surface of drum 15 engages the lowermost cigarette which is immediately supported upon the wall 38.

Mounted in the outlet channel 32 there is a glow head or ignition head 33 provided with a plurality of electrically heated resistance wires, head 33 also serving as an ejector or stripper which expels cigarettes outwardly from the outlet channel 32. The glow head 33 has a lateral supporting arm 34 which is threadedly mounted on the traversing screw 16 so that upon the rotation of the screw 16 by the motor 19 in the proper direction the arm 34 and the head 33 affixed thereto are driven in a direction downwardly in FIGS. 1 and 3. The extent of traverse of the arm 34 and the head 33 is determined by microswitches 35 and 36 mounted upon the housing of the dispenser, such switches being actuated by the arm 34.

When the arm 34 and the glow head 33 have moved from the starting position shown in FIGS. 1 and 3 also the traversing screw 16 toward the switch 36, the glow head 33 is switched on and presses against the confronting end of the cigarette which has been brought to the outlet channel 32. The glow head slides the cigarette while lighting the end thereof which it engages, to an outlet opening (not shown) in the housing 10 the position of such outlet opening being indicated in FIG. 1 by the arrow 37. The lighted cigarette first appears outwardly in the housing 10 after a predetermined length of travel, for example, one quarter of the length of the cigarette, so that it is assured that the cigarette is lighted when it is thrust outwardly sufficiently to be grasped by the smoker.

As soon as the arm 34 bearing the glow head 33 has engaged the switch 36, the current supply to the glow head is switched off and the direction of rotation of the motor 19 is reversed. The arm 34 and the glow head 33 then move back toward their starting positions, shown in FIGS. 1 and 3, until arm 34 engages switch 35, switch 35 then switching motor 19 off. If a new lighted cigarette has been requested by means of the pressing of a service or starting key (not shown) the end switch 35 then functions again to energize the motor 19 in its forward, cigarette lighting and dispensing direction, and the glow head 33 is again energized.

After the reversing of the motor 19 by actuation of the switch 36, not only is the glow head 33 de-energized, but the drum 15 is turned clockwise (FIG. 2) until the member 30 engages stop 29, following which the disconnectable coupling 22, 27 functions to permit the continued reverse rotation of the traverse screw 16 by the motor 19 while the drum 15 remains in its clockwise terminal position. In such clockwise position a new cigarette can slide down the bottom wall 38 into the recess of the drum 15.

The inclined bottom wall 38 of the storage chamber 16 leads to an outlet slot 39 in the storage chamber 17 from which a cigarette can pass. Outlet 39 is limited upwardly by means of a swinging flap 40 which, in the position shown in FIG. 2 presents a gap between its lower end and its upper surface of the wall 38 which somewhat exceeds the diameter of a cigarette 18. The swing flap 40 forms one arm of the swing lever 42 which is mounted for pivoting on a pivot shaft 41 disposed paralled to the axis of the drum 15. The other arm 43 of the swing lever 42, which is longer than and thus weighs more than swing flap 40 is constantly urged by gravity into engagement with the projection 30 on the shaft of the drum 15 when the parts are in the position thereof shown in FIG. 2. With each turning of the drum 15, the swing lever 42 and thus the flap 40 are turned somewhat so as to agitate or jostle the stack of cigarettes 18 on the lower wall 38 of the storage chamber 17, thereby to prevent the jamming of cigarettes in the region of the outlet slot 39.

As above noted, the motor 19 in the glow head 33 may be energized by either direct currect or alternating current. If the cigarette dispenser is to be mounted in a automobile, the automobile battery may serve as the source of energizing electric current for the dispenser.

Although the invention is illustrated and described with reference to a single preferred embodiment thereof, it is to be expressly understood that it is in no way limited by the disclosure of such a single preferred embodiment, but is capable of numerous modifications within the scope of the appended claims.

What is claimed is:

1. In a cigarette dispenser with an ignition arrangement, the dispenser having a housing with a storage chamber for the cigarettes, an ignition head mounted in the interior of the housing, and an arrangement for expelling a lighted cigarette through a housing opening, the improvement wherein the floor of the storage chamber is in the form of a funnel and ends in a discharge slot, and comprising a rotatable drum having a cigarette-receiving recess therein disposed downstream of the discharge slot, a reversible electric motor adapted selectively to rotate the drum in opposite directions, a drive train between the motor and the drum, said drive train having a disconnectable coupling interposed in the drive train, an outlet channel disposed beneath the drum, an ignition head in the channel, and means driven by the motor for driving the ignition head in reverse directions, in its forward travel toward the housing opening the ignition head thrusting a cigarette in the discharge channel toward the opening and lighting it.

2. A cigarette dispenser according to claim 1, wherein the means for driving the ignition head is a traversing screw which extends parallel to the cigarette outlet channel, the screw being driven by the electric motor, and comprising end switches for determining the extent of travel of the ignition head.

3. A cigarette dispenser according to claim 1, wherein the discharge slot of the storage chamber is limited on one side by a swing flap the movement of which is dependent upon the rotatable drum, the flap forming a partial wall for the storage chamber.

4. A cigarette dispenser according to claim 1, wherein along the periphery of the rotatable drum there is provided an extension rigidly secured thereto, the extension coacting with stationary stop surfaces extending into the rotational path of the extension, and the disconnectable coupling comprises an entraining spring which coacts with projections on a gear driven by the electric motor.

5. A cigarette dispenser in accordance with claim 1, wherein the drive train serves for driving the rotatable drum and the traversing screw, and for effecting the reverse switching of the direction of rotation of the electric motor as well as controlling the supply of electric current to the ignition head.

6. A cigarette dispenser in accordance with claim 3, wherein the swing flap forms part of a two-armed pivotally supported member which is contacted by the extension on the rotatable drum.

7. A cigarette dispenser in accordance with claim 1, wherein the electric motor is a low voltage motor which is connected by a transformer to an electrical supply network, said transformer being built into the housing.

8. A cigarette dispenser in accordance with claim 1, wherein the electric motor is a low voltage D.C. motor which is connected to a battery built into the housing or mounted exterior therefrom, for example an automobile battery.

9. A cigarette dispenser in accordance with claim 1, wherein the electric motor is a low-voltage D.C. motor which is disposed exteriorly of the housing.

10. A cigarette dispenser in accordance with claim 1, wherein the rotatable drum is mounted with respect to the cigarette dispensing channel in the housing in such manner that the distance between the end of the cigarette which falls out of the rotatable drum into the outlet channel is thrust at least a distance of one-quarter of its length outwardly from the outlet opening in the housing.

* * * * *